US010145125B2

(12) United States Patent
O'Brien

(10) Patent No.: US 10,145,125 B2
(45) Date of Patent: Dec. 4, 2018

(54) COVE BASE MOLDING SYSTEMS AND METHODS

(71) Applicant: Christopher J. O'Brien, Las Vegas, NV (US)

(72) Inventor: Christopher J. O'Brien, Las Vegas, NV (US)

( * ) Notice: Subject to any disclaimer, the term of this patent is extended or adjusted under 35 U.S.C. 154(b) by 0 days.

(21) Appl. No.: 14/964,561

(22) Filed: Dec. 9, 2015

(65) Prior Publication Data

US 2016/0160510 A1 Jun. 9, 2016

Related U.S. Application Data

(60) Provisional application No. 62/089,670, filed on Dec. 9, 2014.

(51) Int. Cl.
*E04F 19/04* (2006.01)

(52) U.S. Cl.
CPC .. *E04F 19/0477* (2013.01); *E04F 2019/0422* (2013.01)

(58) Field of Classification Search
CPC ... E05D 3/03; E06B 3/30; E06B 3/302; E06B 3/34; E06B 3/7001; E06B 3/7015; E06B 5/10; E06B 5/11; E06B 5/12; E04F 19/04; E04F 19/045; E04F 19/0477; E04F 2019/0422; A47K 3/008
USPC ..... 52/203, 204.53, 204.54, 204.62, 208, 52/716.2, 717.03, 717.05
See application file for complete search history.

(56) References Cited

U.S. PATENT DOCUMENTS 2,114,044 A * 4/1938 Bonnell ..... E04F 19/06 52/277
2,541,768 A * 2/1951 Keller ..... A47K 3/008 4/695
3,222,837 A * 12/1965 Daley ..... A47K 3/008 52/250
3,549,471 A * 12/1970 Denton ..... A47G 27/0456 16/16
4,315,390 A * 2/1982 Schaafsma ..... E04F 19/022 52/255
4,601,149 A * 7/1986 Dokan ..... A47K 3/001 428/100
5,287,667 A * 2/1994 Singhal ..... E04F 19/02 52/287.1

(Continued)

FOREIGN PATENT DOCUMENTS

DE 29711019 U1 * 10/1997 ..... E04F 19/022

OTHER PUBLICATIONS

The Engineering ToolBox, "Temperature Expansion Coefficients for some common Piping Materials," http://www.engineeringtoolbox.com/pipes-temperature-expansion-coefficients-d_48.html (last accessed on May 25, 2016).*

(Continued)

*Primary Examiner* — Theodore V Adamos
(74) *Attorney, Agent, or Firm* — Richards Patent Law P.C.

(57) ABSTRACT

The cove base molding strip includes a body including a planar portion having a front surface and a rear surface and a curved portion having a concave surface continuous with the front surface and a convex surface continuous with the rear surface. The rear surface includes at least a first channel. A cove anchor projects from the convex surface, and the intersection of the front surface and the rear surface define a rounded tip that projects from the planar portion.

16 Claims, 4 Drawing Sheets

(56) References Cited

U.S. PATENT DOCUMENTS

| | | | | | |
|---|---|---|---|---|---|
| 5,553,431 | A * | 9/1996 | Pelosi, Jr. | E04F 19/045 | 52/272 |
| D383,058 | S * | 9/1997 | Riley | D25/123 | |
| 5,941,033 | A * | 8/1999 | Adams | E06B 1/30 | 52/211 |
| 6,324,799 | B1 * | 12/2001 | Salvitti | E04F 19/045 | 52/287.1 |
| 6,401,418 | B1 * | 6/2002 | Senn | E04F 19/04 | 52/287.1 |
| 6,948,287 | B2 * | 9/2005 | Korn | E04B 1/68 | 277/510 |
| 7,118,791 | B2 * | 10/2006 | Martel | A47K 3/008 | 403/231 |
| 7,958,682 | B2 * | 6/2011 | Elzein | E06B 5/12 | 52/203 |
| 8,171,685 | B2 * | 5/2012 | Harrison | E04F 19/022 | 52/254 |
| 2005/0011159 | A1 * | 1/2005 | Standal | B28B 1/14 | 52/716.1 |
| 2008/0172962 | A1 * | 7/2008 | Harrison | E04F 19/022 | 52/287.1 |

OTHER PUBLICATIONS

Machine translation of Foreign reference DE 29711019U1, obtained from http://translationportal.epo.org/emtp/translate/?ACTION=description-retrieval&COUNTRY=DE&ENGINE=google&FORMAT=docdb&KIND=U1&LOCALE=en_EP&NUMBER=29711019&OPS=ops.epo.org/3.2&SRCLANG=de&TRGLANG=en (last accessed on Apr. 25, 2017).*

* cited by examiner

COVE BASE MOLDING SYSTEMS AND METHODS

CROSS-REFERENCE TO RELATED APPLICATION

This application claims the benefit of priority to U.S. Provisional Application No. 62/089,670 filed on Dec. 9, 2014, the disclosure of which is incorporated herein by reference.

BACKGROUND OF THE INVENTION

The present subject matter relates generally to polymeric, pre-formed cove base molding systems and methods. More specifically, the present invention relates to a polymeric cove base molding system utilizing a cove base molding strip including channels and a cove anchor to improve water tightness and bonding strength.

Cove base molding is installed onto the wall/floor junction and includes a concave profile at a lower portion that extends onto the floor to provide an aesthetic and protective finish to the junction. It is typically made of vinyl or wood, which helps the cove base molding to provide some protection of the wall from damage. To install cove base molding, a user typically uses a simple cutting tool, an adhesive, and possibly caulk. The user cuts the desired length of base molding using the cutting tool, applies adhesive to the back of the base molding, and firmly presses it onto the wall. Caulk may be used to fill in any gaps between the top of the molding and the wall.

Existing cove base molding technology is flammable, is not impact resistant, and is a poor water barrier. When fire tested, conventional cove base molding catches fire, creating a hazard to the consumer. Under tensile and impact testing, the material deforms and can be penetrated. Traditional cove base molding also fails to create a fully watertight installation, creating a porous structure at the wall/floor junction that can harbor and promote the growth of mold and mildew hazards. These cove base moldings have flat back surfaces that are adhered to wall and floor. The flat design results in a relatively low bond strength of the adhesive to the cove base molding and substrate, increasing the potential for moisture intrusion between the wall and the cover base molding.

An alternative to cove base molding is traditional wood baseboard material. When installing wood baseboards, a user must use multiple tools to cut baseboards for corners. Angles must be measured and cut precisely so that the baseboards fit together and form a flush connection. In contrast, polymeric cove base molding is less expensive and easier to install. Unlike the installation of wood baseboards, the installation of polymeric cove base molding does not require a high level of precision because the cove base molding is flexible and easily cut.

Accordingly, there is a need for a cove base molding system that provides a durable and complete moisture barrier and is easy to install, as described herein.

BRIEF SUMMARY OF THE INVENTION

To meet the needs described above and others, the cove base molding systems and methods of the present disclosure utilize a polymeric cove base molding strip that helps to provide a more complete moisture barrier at the wall/floor junction. A body of the cove base molding strip has a planar portion that includes a front surface and a rear surface and a curved portion having a concave surface continuous with the front surface and a convex surface continuous with the rear surface. The rear surface includes one or more channels, and the front and rear surfaces intersect to define a rounded tip that projects rearwardly in the resting position. A cove anchor projects from the convex surface into the wall/floor junction in the installed position.

The channels, the cove anchor, and the rounded tip work together to provide the moisture barrier when installed. The channels form a mechanical lock by increasing the contact area of the adhesive to the cove base molding as well as providing a partially enclosed structure to confine the adhesive, thereby increasing the bond strength of the adhesive to the cove base molding strip. The cove anchor provides an additional moisture barrier and bond strength when adhered to the wall/floor junction by means of an adhesive. The rounded tip helps to create a seal at the wall when the strip is installed. Therefore, the polymeric base molding system creates a superior bond adhesion to the floor and the wall, provides a complete moisture barrier, and prevents moisture intrusion and bacterial growth. While all of these features improve the water tightness of the system, the system may include more or fewer features depending on the requirements of the environment in which it is installed.

To install the cove base molding, the user cuts the desired length of the cove base molding strip if necessary (which may come in sections of varying sizes), applies a bead of adhesive to the channels on the rear surface, applies a bead of adhesive to the wall/floor junction, and presses the molding firmly into the desired location. In contrast to the traditional cove base molding having a flat back, the channels in the rear surface as well as the cove anchor of the cove base molding strips of the present application provide partially enclosed surfaces with greater surface area for the adhesive to contact and locking the adhesive within the cove base molding strip, increasing the adhesive bond and thereby ensuring that the cove base molding stays firmly in place while also creating a waterproof barrier. Because the material of the molding can expand, it will not crack and/or separate with time like traditional systems might.

In one embodiment, a cove base molding strip of the present application comprises a body including a planar portion having a front surface and a rear surface and a curved portion having a concave surface continuous with the front surface and a convex surface continuous with the rear surface. The rear surface includes at least a first channel. A cove anchor projects from the convex surface, and the intersection of the front surface and the rear surface define a rounded tip that projects from the planar portion.

In some embodiments, the rounded tip projects rearward of the rear surface. In other embodiments, the front surface and the rear surface define the rounded tip at an upper end of the body, and wherein a planar bottom surface bridges the concave surface and the convex at a lower end of the body.

In still further embodiments, the rear surface includes a second channel spaced from the first channel, and each of the first channel and the second channel has a dovetail shape.

In an addition embodiment, the base molding strip includes a cove anchor projects from the convex surface at an angle of about 45 degrees relative to the planar portion. In a further embodiment, the cove anchor includes a head portion including first and second planar surfaces.

In further embodiments, the body comprises a material having an expansion coefficient of between about 25 and about 55, preferably between about 28 and about 50.4. For example, the material may be a polymer.

In still a further embodiment, a method of the present application for installing a base molding strip to a wall/floor junction includes the step of providing a base molding strip. The strip comprises a body including a planar portion having a front surface and a rear surface and a curved portion having a concave surface continuous with the front surface and a convex surface continuous with the rear surface. The rear surface includes at least a first channel. A cove anchor projects from the convex surface, and the intersection of the front surface and the rear surface define a rounded tip that projects from the planar portion. The method further includes the steps of applying a first adhesive bead to the one or more channels, applying a second adhesive bead to the wall/floor junction, and positioning the base molding on the wall so that the first adhesive bead contacts the wall and the anchor contacts the second adhesive bead.

In a further embodiment, the method comprises the step of applying adhesive to the wall prior to the step of positioning the base molding on the wall. Further, the method may also include the step of applying pressure to the base molding strip such that the rounded tip forms a seal against the wall.

In an additional embodiment, the providing step comprises providing first and second base molding strips, each strip including vertical ends. The method further comprises the step of applying a third adhesive bead to a vertical end of the first base molding strip and securing the vertical end of the first base molding strip to the vertical end of the second base molding strip.

An object of the invention is to provide a cove base molding with a complete moisture barrier, thus preventing moisture intrusion and bacterial growth.

Yet another advantage of the invention is that the cove base molding system can be installed easily and quickly.

A further advantage of the invention is that the cove base molding system utilizes mitered base molding strips to form corners, rather than requiring a pre-fabricated angled corner.

Another advantage of the invention is that the cove base molding strip comprises a material that is not flammable and has increased strength to resist impacts and tension.

Another advantage of the invention is that it has an expansion coefficient similar to epoxy to eliminate cracking and separation.

Additional objects, advantages and novel features of the examples will be set forth in part in the description which follows, and in part will become apparent to those skilled in the art upon examination of the following description and the accompanying drawings or may be learned by production or operation of the examples. The objects and advantages of the concepts may be realized and attained by means of the methodologies, instrumentalities and combinations particularly pointed out in the appended claims.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION

Figure 1:
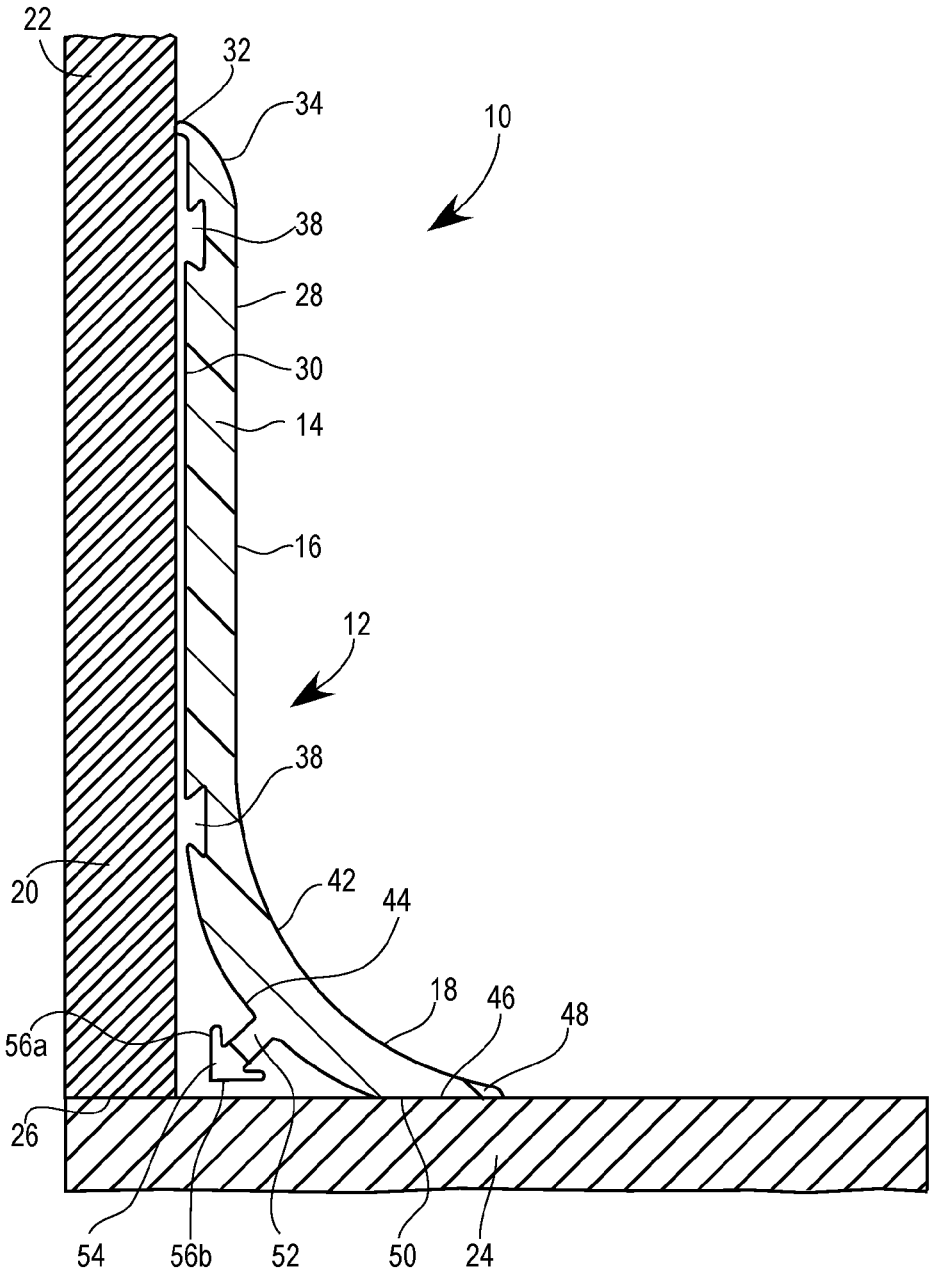
FIG. 1 is an elevational view of a cross section of a cove base molding strip in the resting position.
Figure 2:
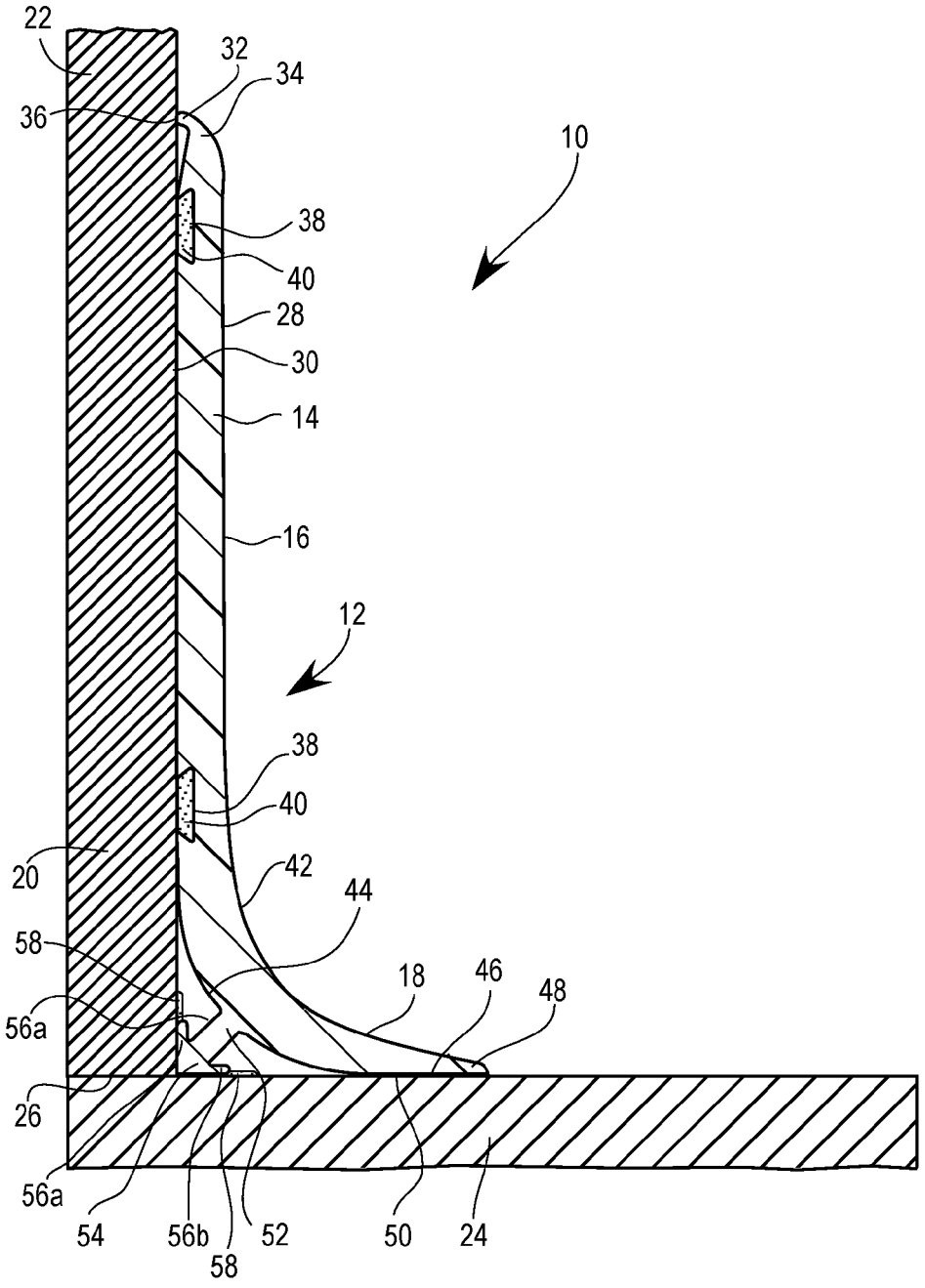
FIG. 2 is an elevational view of a cross section of the cove base molding strip of FIG. 1 in the installed position.

The cove base molding systems 10 and methods of the present application utilize a cove base molding strip 12 that includes a body 14 having a planar portion 16 and a curved portion 18 as shown in FIG. 1. Referring to FIG. 2, the planar portion 16 is secured to a lower portion 20 of a wall 22 and the curved portion 18, referred to as the cove, extends onto the floor 24 so that it covers a wall/floor junction 26 when the cove base molding system 10 is installed.

Shown in FIGS. 1 and 2, the planar portion 16 includes a front surface 28 and a rear surface 30 that intersect to define a rounded or radiused tip 32 at an upper end 34 of the body 14. In the illustrated embodiment, the rounded tip 32 projects rearward of the rear surface 30. The rounded tip 32 extends beyond the rear surface 30 in the resting position so that movement of the rear surface 30 into the installed position causes the rounded tip 32 to deform slightly which, when constructed from an elastic material, causes the rounded tip 32 to press firmly against the wall 22, creating a seal 36 that acts as a moisture barrier. The curved shape of the rounded tip 32 provides a smaller surface area of the upper end 34 of the cove base molding strip 12, thereby minimizing the amount of dust that can accumulate along the top of the cove base molding strip 12. The seal 36 created by the rounded tip 32 and the wall 22 also eliminates the need for caulking this junction.

The rear surface 30 of the planar portion 14 includes one or more channels 38 that receive a bead of adhesive 40 during installation as shown in FIG. 2. Each channel 38 provides additional surface area to which the adhesive material 40 bonds. Further, each channel 38 may be partially enclosed (for example, with a narrowing near the opening of the channel 38 at the rear surface 30) so that an opening of the channel has a width that is less than a width of the body of the channel 38. Accordingly, once cured, the adhesive 40 is locked into the channel 38, thereby strengthening the bond between the cove base molding strip 12, the adhesive 40, and the wall 22—the cove base molding strip 12 can not be released from the wall 22 because the cured adhesive 40 in the channel 38 can not be squeezed through the narrowed opening of the channel 38. In the illustrated embodiment, the cove base molding strip 12 includes two spaced channels 38 that extend along the length of the strip 12. In some embodiments, each channel 38 has a dovetail shape, although the shape and size of the channel 38 may vary depending on the molding process and materials used, the mechanical properties of the material, and other related factors.

The curved portion 18 includes a concave surface 42 continuous with the front surface 28 and a convex surface 44 continuous with the rear surface 30. A planar bottom surface 46 bridges the concave surface 42 and the convex surface 44 at a lower end 48 of the body 14. When installed, movement from the resting position to the installed position results in the application of pressure to the planar bottom surface 46, creating a seal 50 that acts as a moisture barrier.

The cove base molding strip 12 also includes a cove anchor 52 that extends into the wall/floor junction 26 when installed to properly position the cove base molding strip 12 on the wall 22 and to provide an additional moisture barrier. In the illustrated embodiment, the cove anchor 52 extends from the convex surface 44 of the cove base molding strip 12 at an angle of about 45 degrees relative to the rear surface 30. A head portion 54 of the cove anchor contacts the wall/floor junction 26 as seen in FIG. 2. In the illustrated embodiment, the head portion 54 includes first and second planar surfaces 56*a*, 56*b* that correspond to the wall 22 and the floor 24, respectively. The shape of the head portion 54 may include more or fewer surfaces of any size and shape as desired. In some embodiments, the cove anchor 52 may have a consistent cross section throughout the length of the cove base molding strip 12. In other embodiments, the cove base molding strip 12 may include one or more cove anchors 52 spaced apart from one another. In the resting position shown in FIG. 1, the cove anchor 52 is spaced apart from the wall/floor junction 26. During installation, the cove anchor 52 is secured to the floor/wall junction 26 by an adhesive 58 as shown in FIG. 2.

Figure 3:
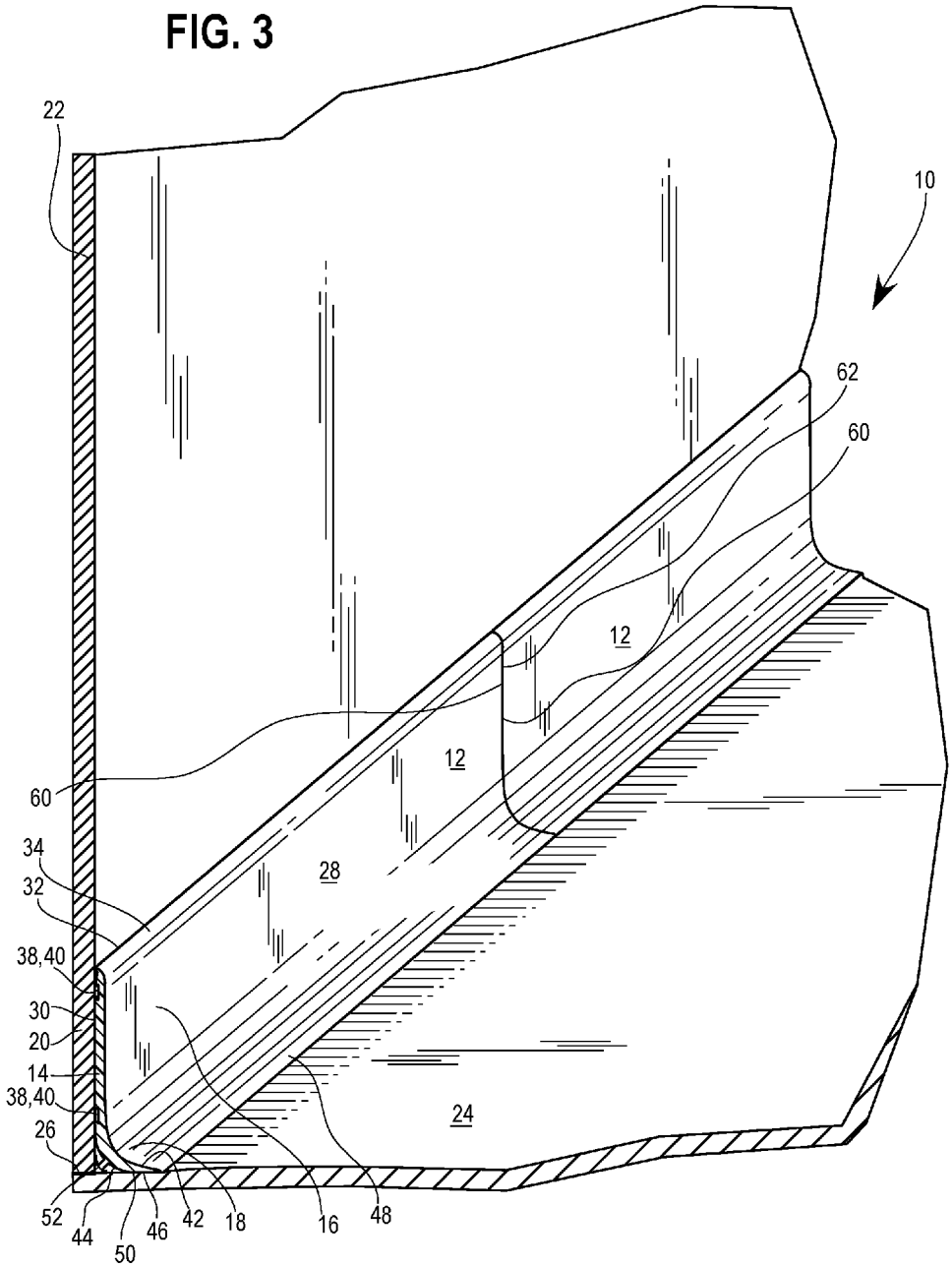
FIG. 3 is a perspective, cross section view of the cove base molding system including the cove base molding strip of FIG. 1 in the installed position.

The cove base molding system 10 may include a plurality of cove base molding strips 12 positioned adjacent to one another as shown in FIG. 3. In one embodiment, the length of each strip 12 is 48 inches, although the length may vary. Adjacent cove base molding strips 12 may be joined together using an adhesive (not visible) along the vertical ends 60 of each strip 12 to form a vertical joint 62. The user may install the cove base molding system 10 around a corner using cove base molding strips 12 with mitered vertical ends (not shown).

Figure 1A:
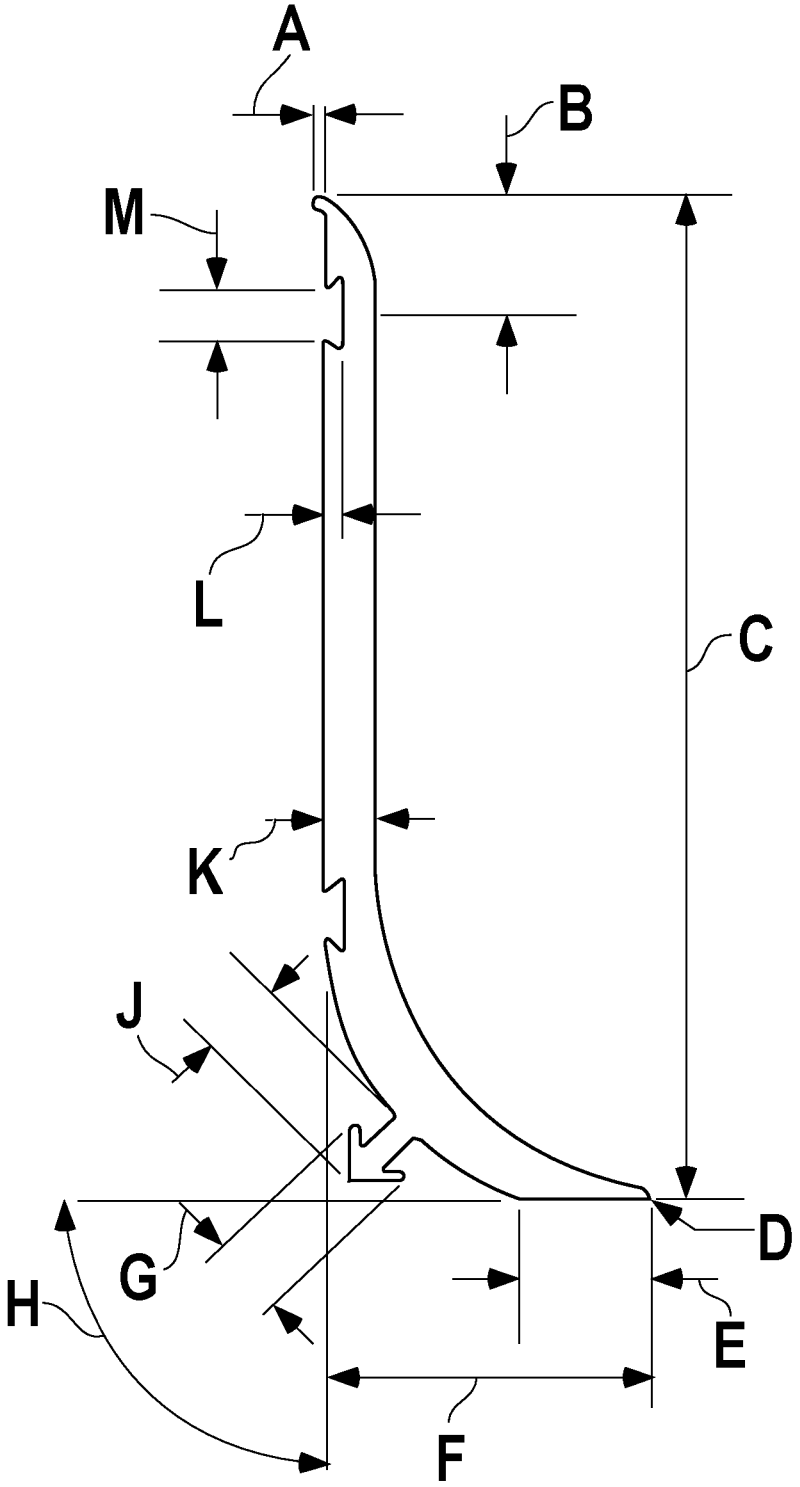
FIG. 1A is an elevational view identical to FIG. 1 illustrating sample dimensions for the cove base molding strip.

In an example embodiment, the cove base molding strip 12 has the dimensions noted in the following table and as seen in FIG. 1A. It should be noted that the dimensions in the following table are exemplary only and not limiting.

TABLE 1

| FIG. 1A | Nominal Dimension (millimeters unless otherwise noted) |
|---|---|
| A | 0.025 |
| B | 0.470 |
| C | 4.000 |
| D | 0.025 (radius of curvature) |
| E | 0.515 |
| F | 1.250 |
| G | 0.281 |
| H | 90 degrees |
| J | 0.300 |
| K | 0.200 |
| L | 0.070 |
| M | 0.207 |

The cove base molding strip 12 may be made of any suitable material that has an expansion coefficient similar to that of epoxy in order to eliminate cracking and separation. In a preferred embodiment, the expansion coefficient is between about 28 and about 50.4 An example material is a polymer, although any other suitable material or combinations of materials may be used. The adhesive material 40, 58 used to adhere the cove base molding strip 12 to the wall 22 and the floor 24 may be a two component, fast drying adhesive, or any other suitable adhesive. The adhesive material (not visible) used to join two adjacent cove base molding strips 12 as described below may be a single component, low viscosity, cyanoacrylate adhesive, although any other suitable adhesive may be used.

To install the cove base molding system 10, the user determines the number of cove base molding strips 12 needed. If more than one strip 12 is necessary, the user may join adjacent strips 12 prior to installation or during installation. For example, the user may apply an adhesive to the vertical ends 60 of adjacent first and second strips 12 to form a continuous strip, and then mount the continuous strip to the wall 22. Alternatively, the user may apply the first strip 12 to the wall 22 according to the following description, then apply an adhesive to the vertical end 60 of the first strip 12 and/or the vertical end 60 of the second strip 12, and then mount the second strip 12 to the wall immediately adjacent to the first strip 12 to form the joint 62. In either embodiment, the cove base molding system 10 may include pins or other fastening mechanisms that bridge the channels 38 of adjacent cove base molding strips 12 to join adjacent strips 12.

Prior to mounting each cove base molding strip 12 (or continuous strip) to the wall 22, the user applies an adhesive bead 40 to the one or more channels 38 on the rear surface 30 of the base molding strip 12 and an adhesive bead 58 to the wall/floor junction 26. The user may optionally apply a bead of adhesive to the wall 22 as well. The user then positions the base molding strip 12 on the wall 22 so that the adhesive bead 40 on the one or more channels 38 contacts the wall 22 and the cove anchor 52 contacts the adhesive bead 58 on the wall/floor junction 26. The user applies pressure and holds the strip 12 in place as the adhesives 40, 58 dries. If any gaps are formed between the upper end 34 of the strip 12 and the wall 22, the user may insert adhesive 40, 58 into the gap and apply pressure until the adhesive 40, 58 dries in order to close the gap. The user may also apply additional adhesive 40, 58 atop vertical joints 62 to strengthen the joint 62.

It should be noted that various changes and modifications to the presently preferred embodiments described herein will be apparent to those skilled in the art. Such changes and modifications may be made without departing from the spirit and scope of the present invention and without diminishing its attendant advantages.

I claim:

1. A cove base molding strip positioned adjacent to a floor/wall junction, comprising:

a body including a planar portion having a front surface and a rear surface, a curved portion having a concave surface continuous with the front surface and a convex surface continuous with the rear surface, and a planar bottom surface bridging the concave surface and convex surface at a lower end of the body;

wherein the body has a body height and the planar bottom surface has a planar bottom surface width, and wherein the ratio of the body height to the planar bottom surface width is about 8;

wherein the rear surface includes at least a first channel and a second channel recessed within the planar portion at opposite ends thereof; and first and second beads of adhesive applied to the first and second channels, respectively;

wherein a cove anchor projects from the convex surface; and wherein an intersection of the front surface and the rear surface define a rounded tip that projects from the planar portion.

2. The base molding strip of claim 1, wherein the body comprises a polymeric material.

3. The base molding strip of claim 1, wherein the rounded tip projects rearward of the rear surface.

4. The base molding strip of claim 1, wherein the front surface and the rear surface define the rounded tip at an upper end of the body, and wherein the planar bottom surface bridges the convex surface and the concave surface at a lower end of the body.

5. The base molding strip of claim 1, wherein the first channel includes an opening in the rear surface and a volume within the body, wherein the opening has an opening width and the volume has a volume width, and wherein the first channel is partially enclosed so that the opening width is less than the volume width.

6. The base molding strip of claim 5, wherein the first channel has a dovetail shape in cross section.

7. The base molding strip of claim 1, wherein each of the first channel and the second channel has a dovetail shape in cross section.

8. The base molding strip of claim 1, wherein the cove anchor projects from the convex surface at an angle of about 45 degrees relative to the planar portion.

9. The base molding strip of claim 8, wherein the cove anchor includes a head portion including first and second planar surfaces.

10. The base molding strip of claim 1, further comprising an adhesive.

11. The base molding strip of claim 1, wherein the body comprises a material that is not flammable.

12. The cove base molding strip of claim 1, wherein the planar bottom surface width is at least about 0.5 in.

13. A method for installing a base molding strip to a junction of a wall and a floor comprising:

providing a base molding strip comprising:

a body including a planar portion having a front surface and a rear surface and a curved portion having a concave surface continuous with the front surface and a convex surface continuous with the rear surface;

wherein the rear surface includes at least a first channel and a second channel recessed within the planar portion at opposite ends thereof;

wherein a cove anchor projects from the convex surface; and wherein the intersection of the front surface and the rear surface define a rounded tip that projects from the planar portion; and applying a first adhesive bead within the first channel;

applying a second adhesive bead within the second channel;

applying a third adhesive bead to the wall/floor junction;

positioning the base molding strip on the wall so that the rear surface of the body directly contacts the wall while the first adhesive bead within the first channel contacts the wall and the anchor contacts the second adhesive bead; and positioning the cove anchor in contact with the junction of the wall and the floor.

14. The method of claim 13, further comprising the step of applying the third adhesive bead to the wall prior to the step of positioning the base molding on the wall.

15. The method of claim 13, further comprising the step of applying pressure to the base molding strip such that the rounded tip forms a seal against the wall.

16. The method of claim 13, wherein the providing step comprises providing first and second base molding strips, each strip including vertical ends, and wherein the method further comprises the step of applying a fourth adhesive bead to a vertical end of the first base molding strip and securing the vertical end of the first base molding strip to the vertical end of the second base molding strip.

* * * * *